US007663317B2

(12) United States Patent
Ko

(10) Patent No.: US 7,663,317 B2
(45) Date of Patent: Feb. 16, 2010

(54) PLASMA DISPLAY PANEL

(75) Inventor: Ji-Sung Ko, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 362 days.

(21) Appl. No.: 11/715,988

(22) Filed: Mar. 9, 2007

(65) Prior Publication Data

US 2007/0228976 A1 Oct. 4, 2007

(30) Foreign Application Priority Data

Mar. 29, 2006 (KR) ..... 10-2006-0028290

(51) Int. Cl.
*H01J 17/49* (2006.01)

(52) U.S. Cl. ..... 313/586; 313/587

(58) Field of Classification Search ..... 313/292, 313/582–587, 486, 487; 345/60, 67
See application file for complete search history.

(56) References Cited

U.S. PATENT DOCUMENTS 6,583,561 B2 * 6/2003 Sawada et al. ..... 313/587
2005/0040767 A1 * 2/2005 Yoo et al. ..... 313/587
2006/0175971 A1 * 8/2006 Yoo et al. ..... 313/586
2006/0226778 A1 * 10/2006 Choo ..... 313/582
2006/0267499 A1 * 11/2006 Yoo et al. ..... 313/582

* cited by examiner

*Primary Examiner*—Karabi Guharay
*Assistant Examiner*—Brenitra M Lee
(74) *Attorney, Agent, or Firm*—Lee & Morse, P.C.

(57) ABSTRACT

A plasma display panel includes first and second substrates having a predetermined gap therebetween. Barriers are disposed between the first and second substrates to partition discharge cells and fluorescent layers are formed in the discharge cells. Address electrodes corresponding to the discharge cells extend in a first direction, and pairs of first and second electrodes extend in a second direction to cross the first direction. The address electrodes are on one of the substrates to correspond to the discharge cells. A dielectric layer covers the first and second electrodes, wherein the dielectric layer is colored with a first color, the barriers are colored with a second color having a subtractive mixture relation with the first color, and wherein the fluorescent layers include first fluorescent layers on the barriers and the discharge cells, and second fluorescent layers on the first fluorescent layers in the second color.

20 Claims, 4 Drawing Sheets

PLASMA DISPLAY PANEL

BACKGROUND OF THE INVENTION

1. Field of the Invention

The present invention relates to a plasma display panel and, more particularly, to a plasma display panel capable of minimizing luminance deterioration even when employing a colored fluorescent layer and improving a bright room contrast ratio.

2. Description of the Related Art

In general, a plasma display panel is a display device that may use vacuum ultra-violet (VUV) rays emitted from plasma obtained through gas discharge so as to excite a fluorescent material. The excited fluorescent material may generate visible light of red (R), green (G), and blue (B), so that an image may be displayed.

For example, an alternating current (AC) type plasma display panel may have a structure in which address electrodes may be formed on a rear substrate and covered with a dielectric layer. Barriers may be disposed between the address electrodes on the dielectric layer in a stripe pattern. Fluorescent layers of red (R), green (G), and blue (B) may be formed at the barriers. On a front substrate facing a rear substrate, display electrodes, e.g., pairs of sustain electrodes and scan electrodes, may be formed along a direction that crosses the address electrodes. The display electrodes may be covered with a dielectric layer and an MgO protective layer. A discharge cell may be formed at a position where the address electrode on the rear substrate crosses the pair of the display electrodes on the front substrate. Millions or more unit discharge cells may be arrayed in a matrix pattern inside the plasma display panel.

In order to operate the discharge cells of the plasma display panel, memory characteristics may be used. More specifically, in order to generate discharge between the pairs of sustain and scan electrodes which may be included in the display electrode, a potential difference greater than a predetermined voltage may be required. The boundary of the voltage may be called a firing voltage Vf. When a scan voltage and an address voltage Va are applied to the scan electrode and the address electrode, respectively, discharge may occur, and plasma may be formed in the discharge cell. Electrons and ions of the plasma move toward electrodes having opposite polarities from each other.

Each electrode of the plasma display panel may be coated with a dielectric layer, so that most of the moved space charge may be accumulated on the dielectric layer having an opposite polarity. Accordingly, net space charge between the scan and the address electrodes may become lower than an address voltage Va that is applied in advance, so that discharge may be decreased, and address discharge may be terminated. In this case, a relatively small amount of electrons may be accumulated on the sustain electrode, and a relatively large amount of ions may be accumulated on the scan electrode. Charge accumulated on the dielectric layer covering the sustain and scan electrodes may be called a wall charge Qw, and space charge formed between the sustain and scan electrodes by the wall charge Qw may be called a wall voltage Vw.

In a case where a discharge sustain voltage Vs may be applied to the sustain and scan electrodes, when a value Vs+Vw of adding the discharge sustain voltage Vs and the wall voltage Vw is larger than the firing voltage Vf, sustain discharge may occur in the discharge cell. VUV generated at this time may excite a corresponding fluorescent material so as to emit visible light through the transparent front substrate.

However, when an address discharge between the scan and address electrodes does not exist, e.g., when the address voltage Va is not applied, the wall charge may not be accumulated between the sustain and scan electrodes, and as a result, the wall voltage between the sustain and scan electrodes may not exist. In this case, only the discharge sustain voltage Vs applied to the sustain and scan electrodes may be formed in the discharge cell. In addition, since the discharge sustain voltage Vs may be lower than the firing voltage Vf, gas space between the sustain and scan electrodes may not be discharged.

There have been various attempts to improve the bright room contrast ratio by increasing a black area ratio that may be a ratio of a black color in the plasma display panel operated as described above, i.e., a method of using a complementary color relation has been developed.

In the plasma display panel using the complementary color relation, the dielectric layer of the front substrate may be colored with a shade of blue, and the barriers of the rear substrate may be colored with a shade of red in order to improve the bright room contrast ratio.

In addition, in the plasma display panel using the complementary color relation, the fluorescent layers on the rear substrate may be colored with a shade of red similar to the barriers in order to further improve the bright room contrast ratio.

However, although the plasma panel display improves the bright room contrast ratio by coloring the fluorescent layers with the shade of red, a large amount of visible light generated in the discharge cell may be absorbed by the fluorescent layers colored with the shade of red, so that luminance may be decreased.

SUMMARY OF THE INVENTION

The present invention is therefore directed to a plasma display panel, which substantially overcomes one or more of the problems due to the limitations and disadvantages of the related art.

It is therefore a feature of an embodiment of the present invention to provide a plasma display panel which includes colored fluorescent layers to improve the bright room contrast ratio.

It is therefore a feature of an embodiment of the present invention to provide a plasma display panel which includes colored fluorescent layers to improve luminance.

At least one of the above and other features and advantages of the present invention may be realized by providing a plasma display panel that includes a first substrate; a second substrate facing the first substrate with a predetermined gap; a plurality of barriers disposed between the first and second substrates to create a plurality of discharge cells; a plurality of fluorescent layers formed in the discharge cells; address electrodes corresponding to the plurality of discharge cells and extending in a first direction; pairs of first and second electrodes between the substrates and extending in a second direction crossing the first direction and formed on one of the substrates corresponding to the discharge cells; and a dielectric layer covering the pairs of first and second electrodes, wherein the dielectric layer is colored with a first color, the barriers are colored with a second color having a subtractive mixture relation with the first color, and wherein the fluorescent layers include first fluorescent layers formed on the barriers and the discharge cells, and second fluorescent layers formed on the first fluorescent layers in the second color.

The first and second colors may have a complementary color relation. The first color may be brown, and the second color may be blue.

The plurality of barriers may include a plurality of first barrier members extending in the first direction at a predetermined interval corresponding to a discharge cell spacing along the second direction, and a plurality of second barrier members extending in the second direction across the first barrier members at a predetermined interval corresponding to a discharge cell spacing along the first direction.

The first fluorescent layer may be thicker than the second fluorescent layer.

The fluorescent layers may overlap along a direction approximately perpendicular to the second substrate.

The fluorescent layers may include a double layer region having two overlapping colored layers with the first and second colors. The fluorescent layers may include a triple layer region having three overlapping layers that include the first and second colors.

The barriers may include a first barrier end portion formed toward the first substrate, a second barrier end portion that may be wider than the first barrier end portion and formed toward the second substrate, and inclined plane barrier portions formed between corresponding ends of the first barrier end portion and the second barrier end portion.

The double layer region may include a first double layer region corresponding to the first barrier end portion. The double layer region may include a second double layer region corresponding to a thickness of the first fluorescent layer adjacent the first barrier end portion approximately and perpendicular to the first substrate. The double layer region may include a third double layer region corresponding to a region between adjacent second barrier end portions.

The plurality of fluorescent layers may include a first fluorescent layer corresponding to one of red, green, and blue colors, and the second fluorescent layers may be formed on the first fluorescent layers.

According to another embodiment of the present invention, a plasma display panel includes a first substrate; a second substrate facing the first substrate with a predetermined gap; a plurality of barriers disposed between the first and second substrates to create a plurality of discharge cells; a plurality of fluorescent layers formed in the discharge cells; address electrodes corresponding to the discharge cells and extending in a first direction; pairs of first and second electrodes between the substrates and extending in a second direction crossing the first direction and are formed on one of the substrates corresponding to the discharge cells; and a dielectric layer covering the pairs of first and second electrodes, wherein the dielectric layer is colored with a first color, and wherein the plurality of fluorescent layers include colored fluorescent layers colored with a second color having a subtractive mixture relation with at least the first color.

The first and second colors may have a complementary color relation. The barriers may be colored with the second color. The first color may be brown and the second color may be blue.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
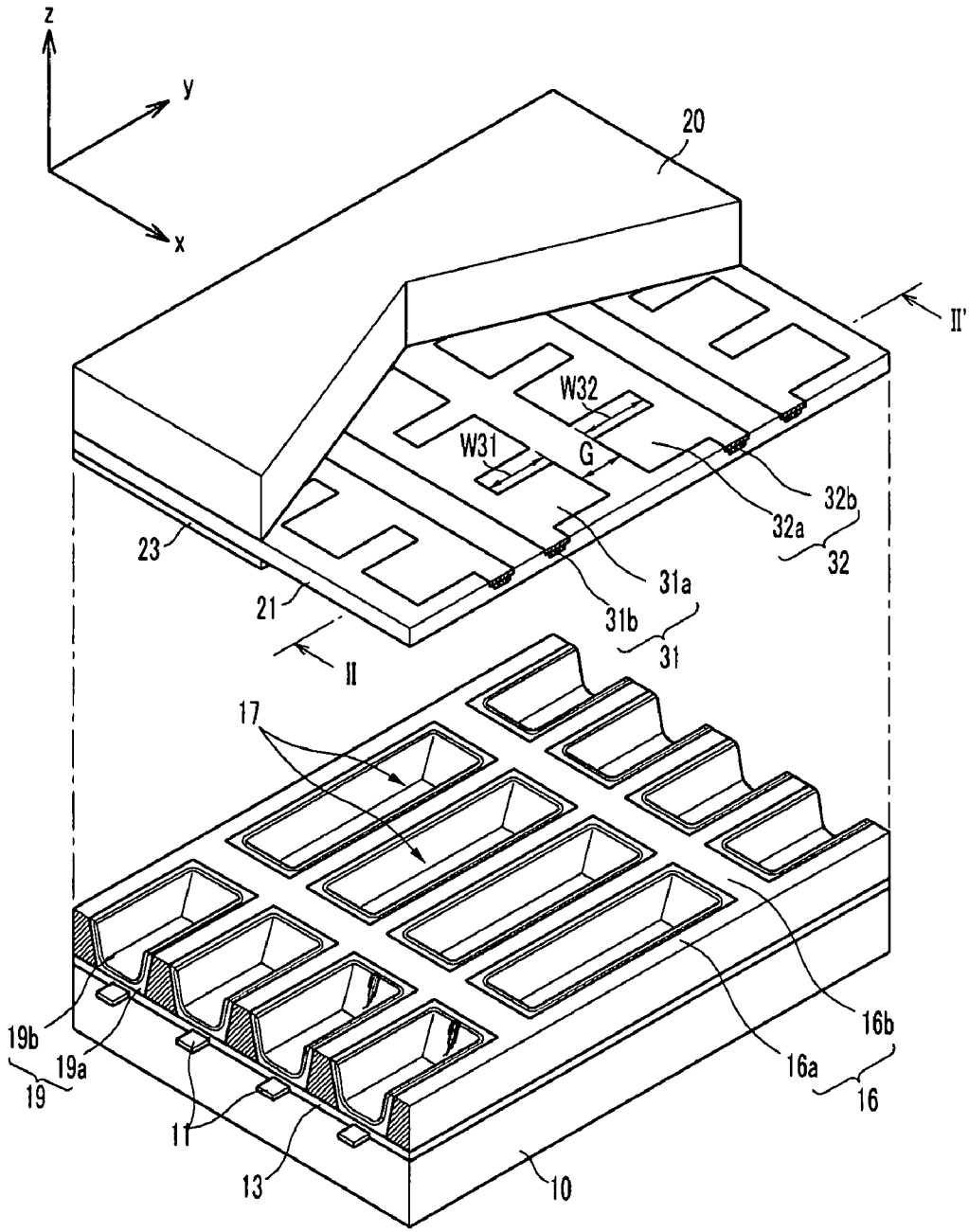
FIG. 1 illustrates a partial, exploded perspective schematic view of a plasma display panel according to an embodiment of the present invention.

Korean Patent Application No. 10-2006-0028290 filed on Mar. 29, 2006 in the Korean Intellectual Property Office and entitled: "Plasma display Panel" is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
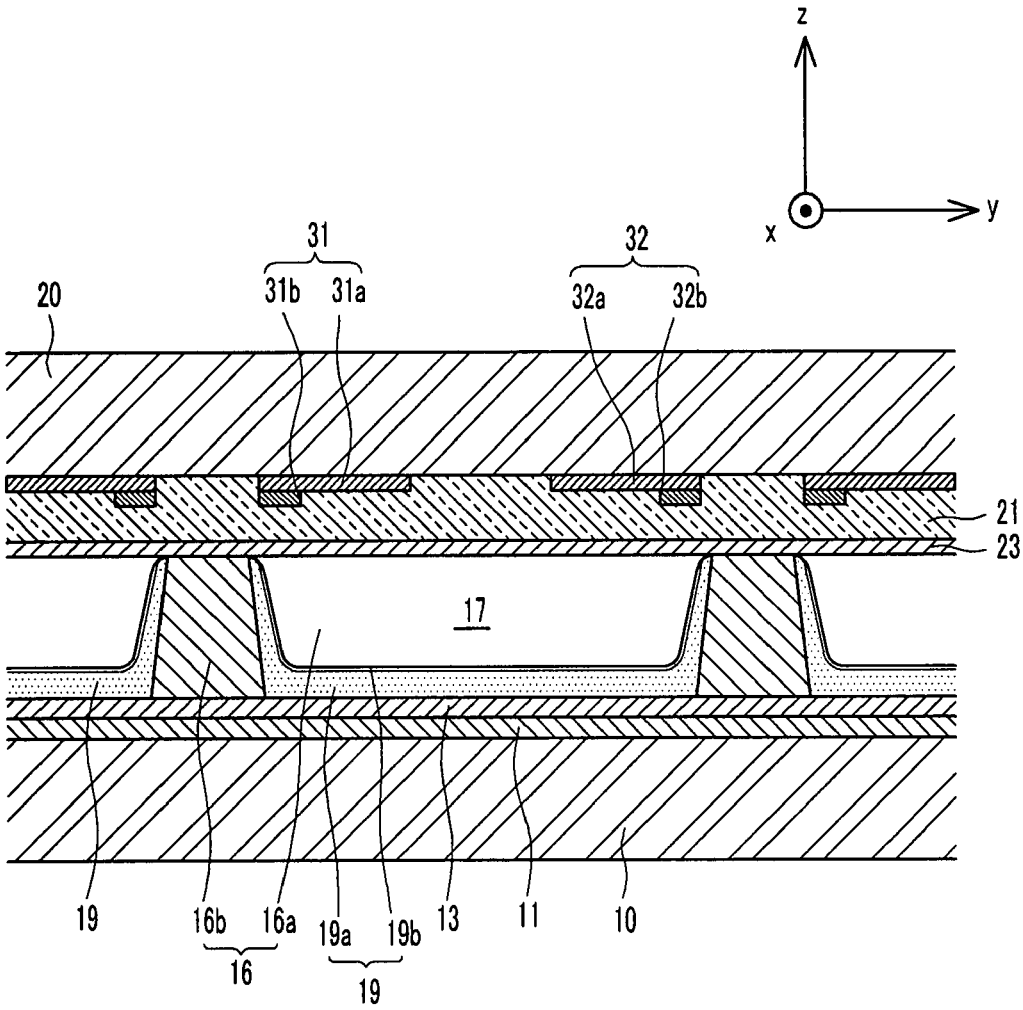
FIG. 2 illustrates a cross-sectional view of the plasma display panel taken along line II-II' of FIG. 1.

FIG. 1 illustrates a partial, exploded perspective schematic view of a plasma display panel according to an embodiment of the present invention. FIG. 2 illustrates a cross-sectional view thereof taken along line II-II' of FIG. 1.

Referring to FIGS. 1 and 2, a plasma display panel according to an embodiment of the present invention may include a first substrate (hereinafter, referred to as a "rear substrate") 10 and a second substrate (hereinafter, referred to as a "front substrate") 20 which may face each other and may be sealed together with a predetermined gap between them. A plurality of barriers 16 may be disposed between the two substrates 10 and 20.

The barriers 16 may have a predetermined height between the front substrate 20 and rear substrate 10 and may partition a plurality of discharge cells 17. The discharge cells 17 may be filled with discharge gas, e.g., a mixture of neon (Ne) and xenon (Xe), so that they may generate vacuum ultra-violet (VUV) radiation by gas discharge, and may include fluorescent layers 19 for emitting visible light upon absorbing the VUV.

The plasma display panel according to an embodiment of the present invention may include an address electrode 11, a first electrode, e.g., a sustain electrode 31, and a second electrode, e.g., a scan electrode 32, corresponding to each discharge cell 17 between the rear substrate 10 and front substrate 20. The address electrodes 11 may be disposed on an inner surface of the rear substrate 10 and may extend in a first direction, e.g., the y-axis, to sequentially correspond to adjacent discharge cells 17 in the y-axis direction. The plurality of sustain electrodes 31 and scan electrodes 32 may be parallel to each other in a second direction, e.g., x-axis, and may cross the address electrodes 11 in order to sequentially correspond to adjacent discharge cells 17 in the x-axis direction.

The address electrodes 11 may be covered with a dielectric layer 13 that may also cover the inner surface of the rear substrate 10. The dielectric layer 13 may prevent damage to the address electrodes 11 through positive ions and electrons directly colliding with the address electrodes 11 during discharge. The dielectric layer 13 may form and accumulate wall charges as well. The address electrodes 11 may be disposed on the rear substrate 10 so that they may not interrupt visible light emitting toward the front substrate 20. Thus, the address electrodes 11 may be opaque, e.g., the address electrodes 11 may be made of a metal having a high electroconductivity.

The plurality of barriers 16 may partition the plurality of discharge cells 17 disposed on the dielectric layer 13. The barriers 16 may include first barrier members 16*a* extending in the y-axis direction and second barrier members 16*b* extending in the x-axis direction to form the discharge cells 17 in a matrix structure.

Alternatively, the barriers 16 may include only first barrier members 16*a* extending in the y-axis direction to form the discharge cells in a stripe pattern. In this case, the discharge cells 17 may be continuous along the y-axis direction.

FIG. 1 illustrates an embodiment where the discharge cells 17 may be formed by the barriers 16 in the matrix structure. The striped discharge cell pattern, described above, may be formed by removing the second barrier members 16*b*, to leave only the first barrier members 16*a*.

A fluorescent layer 19 may be formed in each discharge cell 17 by coating a fluorescent material on a side wall of the barrier 16 and a surface of the dielectric layer 13 between the barriers 16 and processing the layer, e.g., drying, exposing, developing, and firing.

The fluorescent layers 19 in the discharge cells 17 that may be disposed along the same row in the y-axis direction may have a fluorescent material with the same color. The fluorescent layers 19 in the discharge cells 17 disposed along the same row in the x-axis direction may repeatedly alternate between red (R), green (G), and blue (B) fluorescent materials.

Figure 3:
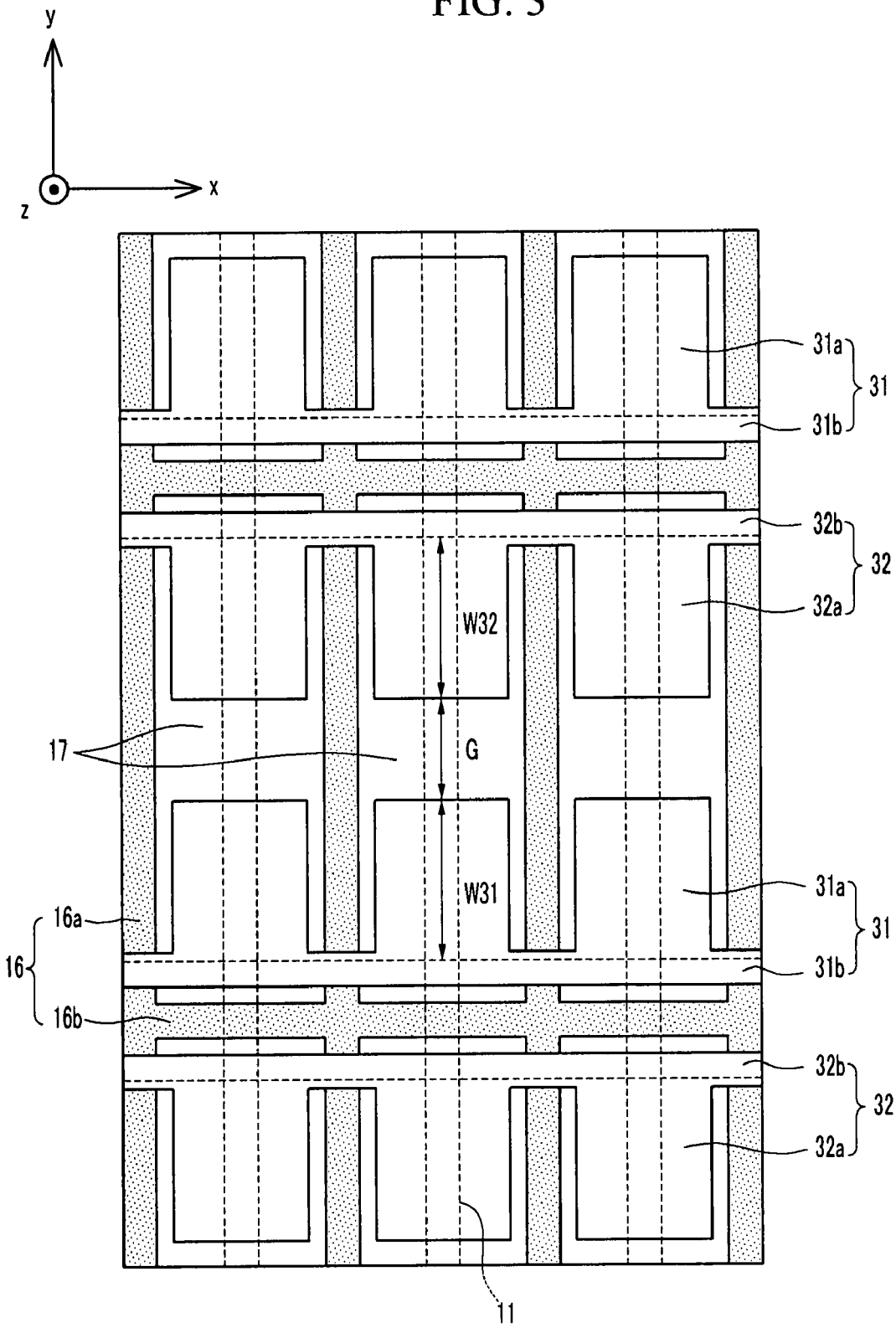
FIG. 3 illustrates a top plan view of an arrangement of discharge cells and electrodes of a plasma display device according to an embodiment of the present invention.

Referring to FIG. 3, the sustain electrode 31 and the scan electrode 32 may be disposed on an inner surface of the front substrate 20 and may correspond to each discharge cell 17 to form a surface-discharge structure in order to generate gas discharge in the discharge cells 17. The sustain electrode 31 and scan electrode 32 may extend in the x-axis direction and may cross the address electrodes 11 that may extend in the y-axis direction.

The sustain electrode 31 and scan electrode 32 may be disposed between the front substrate 20 and rear substrate 10 and may correspond to each discharge cell 17 to form an opposed-discharge structure (not shown).

Each sustain electrode 31 and each scan electrode 32 may include a transparent electrode 31*a*, 32*a* for generating discharge, respectively. Each sustain electrode 31 and each scan electrode 32 may include a bus electrode 31*b*, 32*b* for applying a voltage signal, respectively. The transparent electrodes 31*a*, 32*a* may generate surface-discharge in the discharge cell 17 and may be made of a transparent material, e.g., Indium Tin Oxide (ITO), in order to guarantee an acceptable aperture ratio of the discharge cell 17. The bus electrodes 31*b*, 32*b* may be made of a metal material having a high electroconductivity in order to compensate for a high electric resistance of the transparent electrodes 31*a*, 32*a*.

The transparent electrodes 31*a* and 32*a* may have widths W31 and W32, respectively, and may extend from opposing edges toward a center of a discharge cell 17 along the direction of the y-axis and may form the surface-discharge structure with a discharge gap G in the center of the discharge cell 17. The bus electrodes 31*b*, 32*b* may be disposed on the transparent electrodes 31*a*, 32*a*, respectively. Therefore, when the bus electrodes 31*b*, 32*b* may be applied with a voltage signal, each transparent electrode 31*a* or 32*a* connected to each bus electrode 31*b* or 32*b*, respectively, may also be applied with the voltage signal.

Returning to FIGS. 1 and 2, the sustain electrode 31 and the scan electrode 32 may cross the address electrodes 11 at positions corresponding to each discharge cell 17. The sustain electrode 31 and the scan electrode 32 may be covered with a dielectric layer 21, which may be formed as a single layer. The dielectric layer 21 may protect the sustain electrode 31 and scan electrode 32 from the gas discharge and may form and accumulate wall charges during discharge. The dielectric layer 21 may be covered with a protective layer 23, e.g., transparent MgO, for protecting the dielectric layer 21 to increase a secondary electron emission coefficient during discharge.

During operation of the plasma display panel, during a reset period, reset discharge may occur by a reset pulse that may be applied to the scan electrode 31. In an address period that may follow the reset period, address discharge may occur by a scan pulse applied to the scan electrode 32 and an address pulse applied to the address electrode 11. Thereafter, in a sustain period, sustain discharge may occur by a sustain pulse applied to the sustain electrode 31 and the scan electrode 32.

The sustain electrode 31 and the scan electrode 32 may apply the sustain pulse needed for the sustain discharge, the scan electrode 32 may apply the reset pulse and the scan pulse, and the address electrode 11 may apply the address pulse. The functions of the sustain electrode 31, scan electrode 32, and address electrode 11 may be changed according to voltage waveforms applied thereto, so that the functions are not limited thereto.

The plasma display panel according to an embodiment of the present invention may select a discharge cell 17 to turn on by address discharge through an interaction between the address electrode 11 and the scan electrode 32. The plasma display panel may operate the selected discharge cell 17 by sustain discharge through an interaction between the sustain electrode 31 and the scan electrode 32 in order to create an image.

According to an embodiment of the present invention, the dielectric layer 21 may be colored with a first color, and the barriers 16 may be colored with a second color in order to improve a bright room contrast ratio and luminance. The colors used may have a complementary relation to increase a black area ratio.

The first and second colors may have a subtractive mixture relation and may further have a complementary color relation for representing a black color, e.g., the first color may be brown, and the second color may be blue. The barrier 16 may be colored brown, and the dielectric layer 21 of the front substrate 20 may be colored blue.

The plasma display panel may apply the complementary colors and may decrease the luminance and improve the bright room contrast ratio by increasing the black area ratio, e.g., the blue dielectric layer 21 of the front substrate 20 may increase a color temperature. The blue-colored dielectric layer 21 and the brown-colored barrier 16 may increase the black area ratio of a non-discharge region in the plasma display panel.

In addition, in order to increase the black area ratio of a discharge region along with the non-discharge region, the fluorescent layer 16 may have a plurality of layers including a fluorescent layer colored with the second color, which may have a subtractive mixture relation or a complementary color relation with the first color.

Referring to FIG. 2, the fluorescent layer 19 may include a first fluorescent layer 19*a* formed on an inner surface of the barrier 16 and on the dielectric layer 13 of the rear substrate 10. A second fluorescent layer 19*b* may be coated on the first fluorescent layer 19*a*.

The second fluorescent layer 19*b* and the barrier 16 may be colored brown to increase the black area ratio of the entire plasma display panel. The second fluorescent layer 19*b* may increase the black area ratio, however, the second fluorescent layer 19*b* may absorb visible light emitting onto the front substrate 20. In order to reduce the absorption of visible light, the first fluorescent layer 19*a* may have a first thickness T1, and the second fluorescent layer 19*b* may have a second thickness T2. The second thickness T2 may be smaller than the first thickness T1. Accordingly, the second thickness T2 of the second fluorescent layer 19*b* may cause an increase in the black area ratio of a portion corresponding to the discharge cell 19 so as to increase the bright room contrast. In addition, the absorption of visible light that occurs correspondingly may be reduced, to maintain luminance.

The fluorescent layers 19 may include a plurality of fluorescent layers corresponding to a red, green, or blue color. The second fluorescent layer 19*b* may be formed on only a single fluorescent layer from among the plurality of fluorescent layers.

Figure 4:
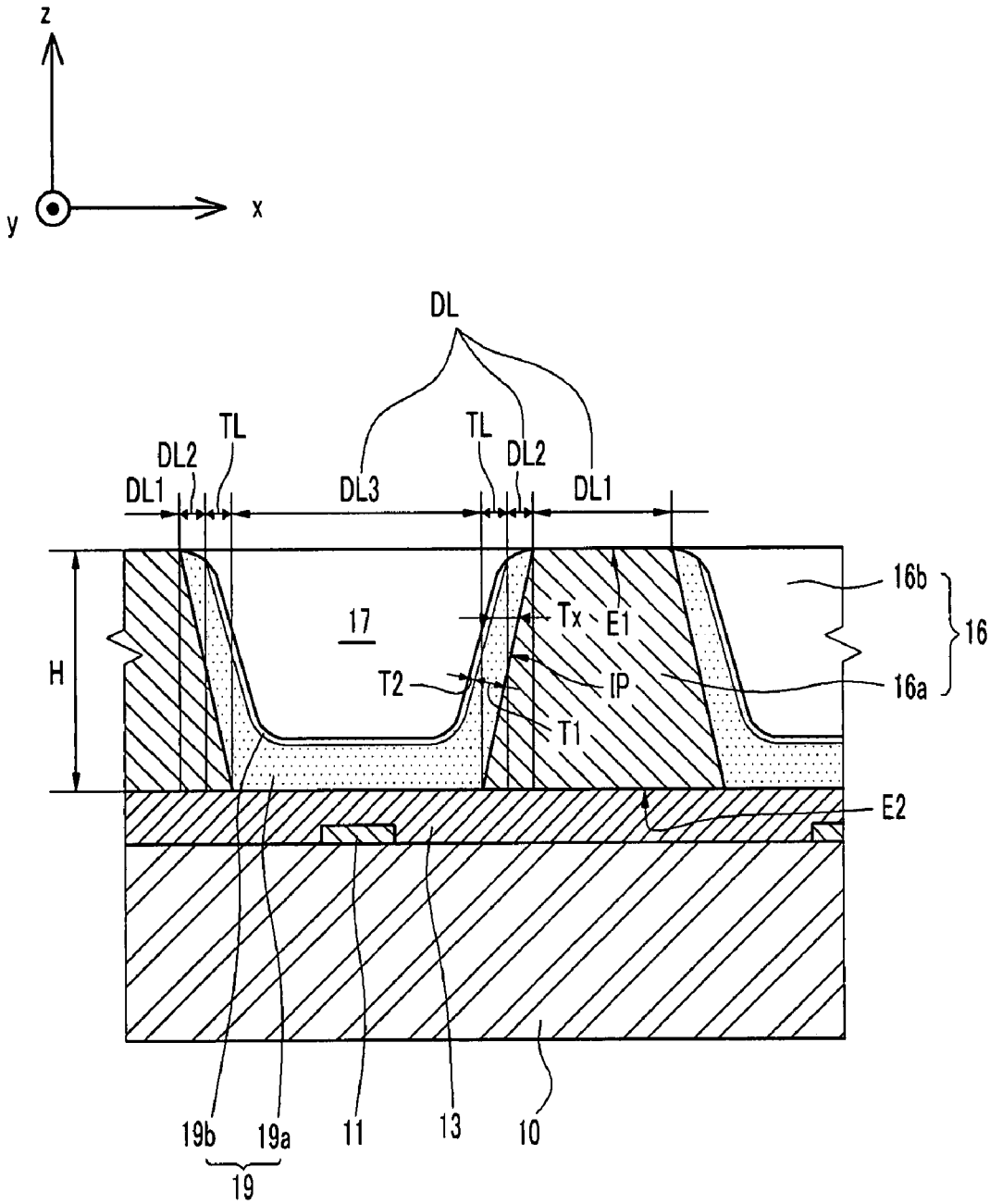
FIG. 4 illustrates a detailed cross-sectional view of the plasma display device showing an overlap relation between a fluorescent layer and a barrier.

Referring to FIG. 4, the first and second colors may form a double layer region DL having two layers that overlap, and a triple layer region TL having three layers that overlap along a vertical direction with respect to the front substrate 20, e.g., z-axis direction.

The cross-sectional shape of the first barrier member 16*a* may be the same as that of the second barrier member 16*b*. Thus, for convenience, only the cross-sectional shape of the first barrier member 16*a* is exemplified and described with reference to FIG. 4.

The barrier 16 may have a predetermined height H and may include a first end portion E1, a second end portion E2 and inclined planes IP. The first end portion E1 may be formed toward the front substrate 20, and a second end portion E2, which may be wider than the first end portion E1, e.g., along the x-axis, may be formed toward the rear substrate 10. Inclined planes IP may be formed between adjacent ends of the first end portions E1 and second end portions E2.

The double layer region DL may include first, second and third double layer regions DL1, DL2, and DL3. The first double layer DL1 region may correspond to the first end portion E1. The first double layer region DL1 may form a black color by using a complementary color of the dielectric layer 21 and the barrier 16, shown in FIG. 2, so that the black area ratio of the non-discharge region may be increased. This arrangement may not interrupt the forward emission of visible light from the rear substrate 10.

The second double layer region DL2 may correspond to a thickness Tx of the first fluorescent layer 19*a* in the x-axis direction against the first end portion E1. The second double layer region DL2 may form a black color by using a complementary color of the dielectric layer 21 and the barrier 16, with the first fluorescent layer 19*a* interposed therebetween, so that the black area ratio of the outer portion of the discharge region may increase. In addition, the forward emission of visible light from the rear substrate 10 may not be interrupted.

The third double layer region DL3 may be formed between the second end portions E2 of adjacent barriers 16. The third double layer region DL3 may form a black color by using a complementary color of the dielectric layer 21 and the second fluorescent layer 19*b*. Therefore, the third double layer region DL3 may increase the black area ratio of the center of the discharge region. The forward emission of visible light may be partially interrupted by the second fluorescent layer 19*b*.

As described above, the third double layer region DL3 may partially absorb the visible light emitting forward from the discharge cell 17. However, since the thickness T1 of the first fluorescent layer 19*a* may be thicker than the thickness T2 of the second fluorescent layer 19*b*, the absorption of visible light may be reduced, and the black area ratio in the discharge region may be increased.

The triple layer TL may be formed between the second double layer region DL2 and the third double layer region DL3. The triple layer TL may include the first and second fluorescent layers 19*a*, 19*b* and may form a black color by using a complementary color of the second florescent layer 19*b*, the dielectric layer 21, and the barrier 16. The triple layer TL may increase the black area ratio of the outer portion of the discharge region.

The triple layer TL may partially absorb visible light emitting forward from the discharge cell 17. However, since the thickness T2 of the second fluorescent layer 19*b* may be thinner than the thickness T1 of the first fluorescent layer 19*a*, the absorption of visible light emitting forward may be reduced. Additionally, the three-layered structure of the barrier 16, the second fluorescent layer 19*b*, and the dielectric layer 31 may increase the black area ratio.

Accordingly, the second fluorescent layer 19*b* having thickness T2 may be thinner than the first fluorescent layer 19*a* having thickness T1 which emits visible light. Therefore, the plasma display panel according to an embodiment of the present invention may increase the black area ratio with a minimum amount of the second fluorescent layer 19*b* colored. In addition, the plasma display panel may also have a luminance similar to that of a plasma display panel having an uncolored fluorescent layer while increasing the bright room contrast.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:

a first substrate;

a second substrate facing the first substrate with a predetermined gap;

a plurality of barriers between the first and second substrates to create a plurality of discharge cells;

a plurality of fluorescent layers in the discharge cells;

a plurality of address electrodes corresponding to the plurality of discharge cells and extending in a first direction;

pairs of first and second electrodes between the substrates and corresponding to the discharge cells, the electrodes extending in a second direction crossing the first direction; and a dielectric layer covering the pairs of first and second electrodes, wherein:

the dielectric layer is colored with a first color, the barriers are colored with a second color having a subtractive mixture relation with the first color, and the fluorescent layers include first fluorescent layers on the barriers and the discharge cells and second fluorescent layers on the first fluorescent layers in the second color.

2. The plasma display panel as claimed in claim 1, wherein the first and second colors have a complementary color relation.

3. The plasma display panel as claimed in claim 1, wherein the first color is brown.

4. The plasma display panel as claimed in claim 3, wherein the second color is blue.

5. The plasma display panel as claimed in claim 1, wherein the plurality of barriers comprise:

a plurality of first barrier members extending in the first direction at a predetermined interval corresponding to a discharge cell spacing along the second direction; and a plurality of second barrier members extending in the second direction across the first barrier members at a predetermined interval corresponding to a discharge cell spacing along the first direction.

6. The plasma display panel as claimed in claim 1, wherein the first fluorescent layer is thicker than the second fluorescent layer.

7. The plasma display panel as claimed in claim 1, wherein the fluorescent layers overlap along a direction approximately perpendicular to the second substrate.

8. The plasma display panel as claimed in claim 7, wherein the fluorescent layers further comprise:

a double layer region having two overlapping colored layers having the first and second colors; and a triple layer region having three overlapping layers and including the first and second colors.

9. The plasma display panel as claimed in claim 8, wherein the barriers comprise:

a first barrier end portion facing the first substrate;

a second barrier end portion that is wider than the first barrier end portion and facing the second substrate; and inclined plane barrier portions between corresponding ends of the first barrier end portion and the second barrier end portion.

10. The plasma display panel as claimed in claim 9, wherein the double layer region comprises a first double layer region corresponding to the first barrier end portion.

11. The plasma display panel as claimed in claim 8, wherein the double layer region comprises a second double layer region corresponding to a thickness of the first fluorescent layer adjacent the first barrier end portion and approximately perpendicular to the first substrate.

12. The plasma display panel as claimed in claim 8, wherein the double layer region comprises a third double layer region corresponding to a region between adjacent second barrier end portions.

13. The plasma display panel as claimed in claim 8, wherein the triple layer region comprises a region between a second double layer region corresponding to a thickness of the first fluorescent layer adjacent the first barrier end portion and approximately perpendicular to the first substrate, and a third double layer corresponding to a region between adjacent second barrier end portions.

14. The plasma display panel as claimed in claim 1, wherein the plurality of fluorescent layers comprises a first fluorescent layer having one color of a set of colors including red, green, and blue, and wherein the second fluorescent layers are formed on the first fluorescent layers.

15. A plasma display panel, comprising:

a first substrate;

a second substrate facing the first substrate with a predetermined gap;

a plurality of barriers between the first and second substrates to create a plurality of discharge cells;

a plurality of fluorescent layers in the discharge cells;

address electrodes corresponding to the discharge cells and extending in a first direction;

pairs of first and second electrodes between the substrates and extending in a second direction to cross the first direction on one of the substrates to correspond to the discharge cells; and a dielectric layer covering the pairs of first and second electrodes, wherein:

the dielectric layer is colored with a first color, and the plurality of fluorescent layers include colored fluorescent layers colored with a second color having a subtractive mixture relation with at least the first color.

16. The plasma display panel as claimed in claim 15, wherein the barriers are colored with the second color.

17. The plasma display panel as claimed in claim 15, wherein the first color is brown and the second color is blue.

18. The plasma display panel as claimed in claim 15, wherein the plurality of fluorescent layers include first fluorescent layers on the barriers and the discharge cells, and the colored fluorescent layers on the first fluorescent layers.

19. A plasma display panel, comprising:

a first substrate;

a second substrate facing the first substrate with a predetermined gap;

a plurality of barriers between the first and second substrates to create a plurality of discharge cells;

a plurality of fluorescent layers in the discharge cells;

address electrodes corresponding to the discharge cells and extending in a first direction;

pairs of first and second electrodes between the substrates and extending in a second direction to cross the first direction on one of the substrates to correspond to the discharge cells; and a dielectric layer covering the pairs of first and second electrodes, wherein:

the dielectric layer is colored with a first color, the plurality of fluorescent layers include colored fluorescent layers colored with a second color having a subtractive mixture relation with at least the first color, and the first and second colors have a complementary color relation.

20. The plasma display panel as claimed in claim 19, wherein the plurality of fluorescent layers include first fluorescent layers on the barriers and the discharge cells, and the colored fluorescent layers on the first fluorescent layers.

* * * * *